United States Patent [19]

Hyde

[11] Patent Number: 4,599,873

[45] Date of Patent: Jul. 15, 1986

[54] APPARATUS FOR MAXIMIZING REFRIGERATION CAPACITY

[76] Inventor: Robert E. Hyde, 2229 SE. 170th, Portland, Oreg. 97233

[21] Appl. No.: 575,693

[22] Filed: Jan. 31, 1984

[51] Int. Cl.[4] ..... F25B 1/00

[52] U.S. Cl. ..... 62/498; 62/118; 62/DIG. 2

[58] Field of Search ..... 62/118, DIG. 17, DIG. 2, 62/498, 509, 115

[56] References Cited

U.S. PATENT DOCUMENTS

| | | | |
|---|---|---|---|
| 1,946,328 | 2/1934 | Neff . | |
| 2,145,692 | 1/1939 | Jones . | |
| 2,181,213 | 11/1939 | Smith . | |
| 2,185,515 | 1/1940 | Neeson . | |
| 2,207,728 | 7/1940 | Goodman | 62/509 X |
| 2,207,729 | 7/1940 | Goodman . | |
| 2,244,312 | 6/1941 | Newton . | |
| 2,252,300 | 8/1941 | McGrath . | |
| 2,434,221 | 1/1948 | Newton | 62/DIG. 2 |
| 2,949,750 | 8/1960 | Kramer | 62/DIG. 2 |
| 3,081,606 | 3/1963 | Brose et al. . | |
| 3,111,815 | 11/1963 | Roberts | 62/498 X |
| 3,133,424 | 5/1964 | Palmer | 62/498 X |
| 3,589,140 | 6/1971 | Osborne . | |
| 3,664,150 | 5/1972 | Patterson | 62/509 X |
| 3,722,230 | 3/1973 | Scott et al. . | |
| 3,742,726 | 7/1973 | English . | |
| 3,988,904 | 11/1976 | Ross . | |
| 4,068,494 | 1/1978 | Kramer . | |
| 4,096,706 | 6/1978 | Beckwith | 62/509 X |

*Primary Examiner*—William E. Wayner

*Attorney, Agent, or Firm*—Klarquist, Sparkman, Campbell, Leigh & Whinston

[57] ABSTRACT

A compression-type refrigeration system is disclosed, in which "flash gas" formation is eliminated without artificially maintaining condenser temperature and pressure levels. Condenser temperatures and pressures are allowed to fluctuate with ambient operating conditions, resulting in reduced compressor load and increased refrigeration capacity. After condensation, liquified refrigerant in the conduit between the receiver and the expansion valve is pressurized without adding heat by a centrifugal pump to a pressure sufficient to suppress flash gas in the conduit.

3 Claims, 2 Drawing Figures

APPARATUS FOR MAXIMIZING REFRIGERATION CAPACITY

BACKGROUND OF THE INVENTION

This invention generally relates to the field of mechanical refrigeration, and more particularly to energy-saving compression-type refrigeration systems.

In the operation of commercial freezers, refrigerators, air conditioners, and other compression-type refrigeration systems, it is desirable to maximize refrigeration capacity while minimizing total energy consumption. In addition, it is necessary to suppress the formation of "flash gas." Flash gas is the spontaneous flashing or boiling of liquid refrigerant resulting from pressure losses and frictional heating in refrigerant lines. Various techniques have been developed to eliminate flash gas. However, conventional methods for suppressing flash gas can substantially reduce system energy efficiency.

FIG. 1 represents a conventional mechanical refrigeration system 10 of the type used in a supermarket freezer. Specifically, compressor 12 compresses refrigerant vapor and discharges it through line 14 into condenser 16. Condenser 16 liquifies the refrigerant, which next flows through lines 20*a* and 20 into receiver 22. From receiver 22, the liquid refrigerant flows through line 26 to counter-current heat exchanger 28. After passing through exchanger 28, the refrigerant flows via line 29 through thermostatic expansion valve 30. Valve 30 expands the liquid refrigerant into a vapor which flows into and through evaporator 34. Valve 30 is connected to thermostat 32 by lead wire 31. Thermostat 32 throttles valve 30 to regulate temperatures produced in evaporator 34 by the expanded vapor. Passing through evaporator 34, the expanded refrigerant absorbs heat, aided by circulating fan 38, and then returns to compressor 12 through line 40.

To suppress flash gas, the refrigerant temperature at condenser 16 is conventionally maintained at approximately 95° F. Pressure levels in receiver 22 are conventionally maintained above the flash or boiling point of the refrigerant; 125 PSI for R12 refrigerant, 185 PSI for R22 refrigernt, and 185 PSI for R502 refrigerant. These temperature and pressure levels are sufficient to suppress flash gas formation in lines 26 and 29, but conventional means for maintaining such levels degrade system efficiency.

Various means are used to maintain the temperature and pressure levels stated above. For example, FIG. 1 shows a fan unit 18 connected to sensor 15 in line 20*a*. Controlled by sensor 15, fan unit 18 is responsive to condenser temperature or pressure and cycles on and off to regulate condenser heat dissipation. A pressure-responsive bypass valve 19 in condenser output line 20*a* is also used to maintain pressure levels in receiver 22. Normally, valve 19 is set to enable a free flow of refrigerant from line 20*a* into line 20. When the pressure at the output line of condenser 16 drops below a predetermined minimum, valve 19 operates to permit compressed refrigerant vapors from line 14 to flow through bypass line 14*a* into line 20. The addition to vapor from lines 14 and 14*a* into line 20 increases the pressure in receiver 22, line 26, and line 29, thereby suppressing flash gas.

The foregoing system eliminates flash gas, but is energy inefficient. First, maintaining a 95° condenser temperature reduces compressor capacity and increases energy consumption. Although the 95° temperature level maintains sufficient pressure to avoid flash gas, the resultant elevated pressure in the system produces a back pressure in the condenser which increases compressor work load. The operation of bypass valve 19 also increases back pressure in the condenser. In addition, the release of hot, compressed vapor from line 14 into line 20 by valve 19 increases the specific heat in the system. The added heat necessitates yet a higher pressure to control flash gas formation and reduces the cooling capacity of the refrigerant, both of which reduce efficiency.

Another approach to suppressing flash gas has been to cool the liquid refrigerant to a temperature substantially below its boiling piont. As shown in phantom line in FIG. 1, a subcooler unit 42 has been used in line 26 for this purpose. However, subcooler units require additional machinery and power, increasing equipment cost and reducing overall operating efficiency.

Other methods for controlling the operation of refrigeration systems are disclosed in U.S. Pat. Nos. 3,742,726 to English, 4,068,494 to Kramer, 3,589,140 to Osborne, and 3,988,904 to Ross. For example, Ross discloses the use of an extra compressor to increase the pressure of gaseous refrigerant in the system. The high pressure gaseous refrigerant is then used to force liquid refrigerant through various parts of the system. However, each of these system is complex and requires extensive purchases of new equipment to retrofit existing system. The expenses involved in these purchases usually outweigh the savings in power costs. Thus, none of the above patents provide a simple, low-cost method of eliminating flash gas without extensive system modification. Also, they do not appear to maximize refrigeration capacity.

Accordingly, a need remains for an effective way to suppress flash gas in compression-type refrigeration systems without impairing refrigeration capacity and efficiency.

SUMMARY OF THE INVENTION

One object of the invention is to improve the operating efficiency of compression-type refrigeration systems.

Another object of the invention is to maximize the refrigeration capacity of refrigeration systems.

Yet another object of the invention is economically to suppress the formation of flash gas in refrigeration systems, without impairing refrigeration capacity and efficiency.

A still further object of the invention is to provide a way to inexpensively retrofit existing refrigeration systems to attain the foregoing objects.

This invention provides a refrigeration system which maximizes energy efficiency and suppresses flash gas formation. The system includes a reservoir for storing liquid refrigerant, a refrigerant circuit with an outlet conduit from the reservoir, expansion means connected to the outlet conduit for expanding the liquid refrigerant, an evaporator for receiving the gas and absorbing heat, a condenser means for dissipating heat from the gas, and compressor means for pumping the gas throughout the system.

The system is arranged and operated so that refrigerant temperatures at the condenser means can vary or "float" with ambient temperature levels. This method of operation includes maximizing heat dissipation at the condenser, which reduces refrigerant back pressure and minimizes compressor load or head pressure thereby maximizing volumetric efficiency. In additiion, decreased refrigerant temperatures reduce the specific heat of liquid refrigerant, thereby increasing system cooling efficiency. Consequently, refrigeration capacity is substantially increased over prior refrigeration systems.

To suppress flash gas in the outlet conduit, the refrigerant therein is pressurized, preferably by a centrifugal pump positioned near the reservoir outlet. The pump increases the liquid refrigerant pressure 5 to 12 PSI above the pressure level in the condenser. This pressure increase is sufficient to suppress flash gas in the refrigerant circuit without adding heat. Compressing the liquid refrigerant requires little power and permits the system to operate at lower, more efficient temperatures.

The foregoing and other objects, features, and advantages of the invention will become more readily apparent from the following description of a preferred embodiment, which proceeds with reference to the drawing.

DETAILED DESCRIPTION

Figure 1:
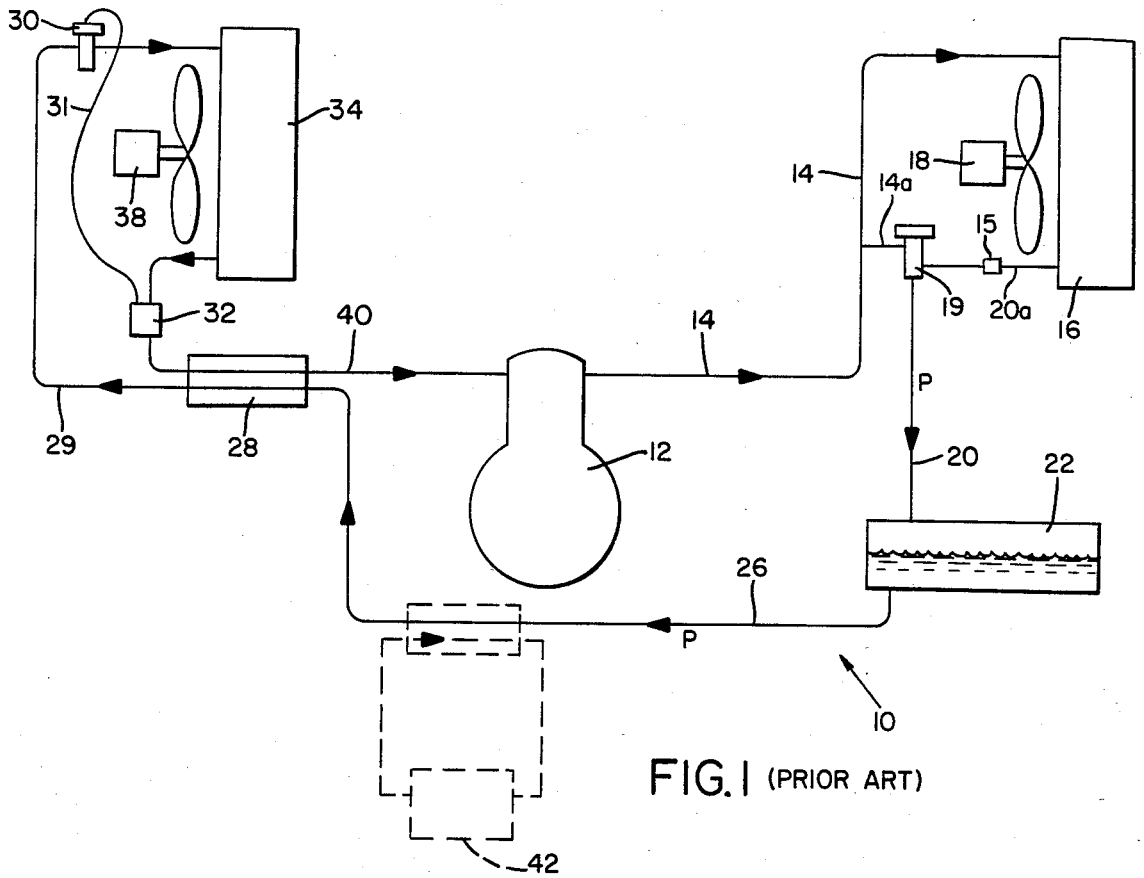
FIG. 1 (PRIOR ART)
FIG. 1 is a schematic diagram of a typical prior art refrigeration system, as previously described.
Figure 2:
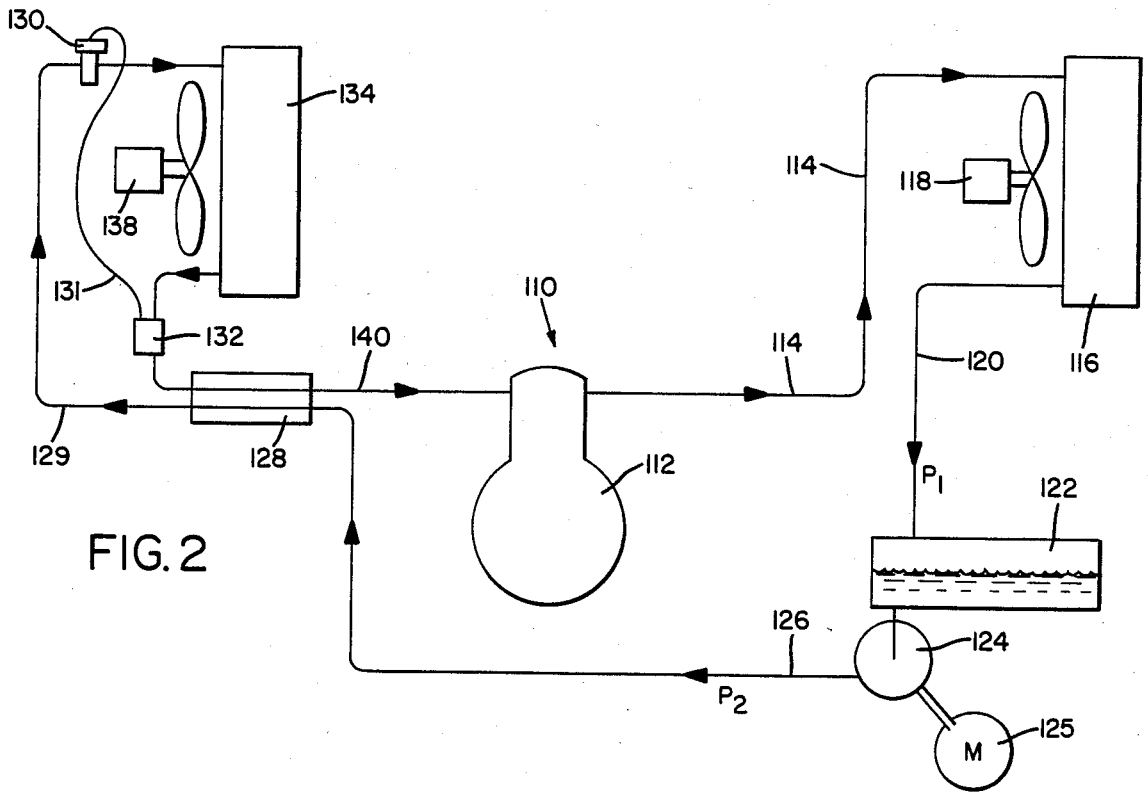
FIG. 2 is a schematic diagram of a refrigeration system embodying the present invention.

Referring now to FIG. 2, a closed circuit compression-type refrigeration system 110 includes a compressor 112, a condenser 116, a receiver 122, an expansion valve 130, and an evaporator 134 connected in series by conduits defining a closed-loop refrigerant circuit. Refrigerant gas (R502, R12, or R22 refrigerant) is compressed by compressor unit 112, and routed through discharge line 114 into condenser 116. A fan 118 facilitates heat dissipation from condenser 116. The condenser cools the compressed refrigerant gases and condenses the gases to a liquid at a reduced pressure $P_1$. From condenser 116, the liquified refrigerant flows through line 120 into receiver 122. Receiver 122 in turn discharges liquid refrigerant into line 126. A centrifugal pump 124, driven by electric motor 125, is positioned in line 126 at the outlet of the receiver to pressurize the liquid refrigerant in lines 126, 129 to an increased pressure $P_2$.

From pump 124, the liquid refrigerant flows through an optional counter-current heat exchanger 128 and line 129 to thermostatic expansion valve 130. Thermostatic expansion valve 130 expands the liquid refrigerant into evaporator 134. Refrigerant flow through valve 130 is controlled by thermostat 132 positioned in line 140 at the output of evaporator 134. A lead wire 131 connects thermostat 132 to valve 130. The expanded refrigerant passes through evaporator 134 which, aided by fan 138, absorbs heat from the area being cooled. The expanded, warmed vapor is returned through line 140 to compressor 112, and the cycle is repeated.

Pump 124 is preferably located as close to receiver 122 as possible, and may be easily installed in existing systems without extensive purchases of new equipment. Pump 124 must be of sufficient capacity to increase liquid refrigerant pressure $P_1$ by at least about 5 PSI. Pump 124 must also be capable of operating under conditions of variable refrigerant discharge from valve 130, including conditions in which valve 130 is closed. A centerifugal pump most effectively and economically provides this capability, but other pumping means which can operate with valve 130 closed can also be used.

In one operative example of the invention, a seven ton, 84,000 BTU/hr refrigeration system with R502 refrigerant and 10 horsepower compressor was retrofitted with a Marsh Model 831 VCI centrifugal water pump and all pre-existing temperature and pressure-maintenance aparatus was removed from the condenser. Powered by a 1/5 horsepower 3450 r.p.m., 230 VAC capacitor-start motor through a magnettic pump drive, this pump is rated at 15 gal./minute, 30.5 feet of head, and a maximum of 13.3 PSI. In operation, as next described, it increases the liquid refrigerant pressure to a pressure $P_2$ about 12 PSI greater than pressure $P_1$ and effectively suppresses flash gas. Energy costs from operation of the system are about 30% less than prior to modification.

Operation

As stated above, compressor 112 compresses the refrigerant vapor, which passes through discharge line 114 to condenser 116. At condenser 116, heat is removed, and the vapor is liquified. At condenser 116, temperature and pressure levels are allowed to fluctuate with ambient air temperatures in an air-cooled system, or with water temperatures in a water-cooled system. This fluctuation permits the system to reach an equilibrium temperature and pressure level ($P_1$). Decreased condenser temperatures increase system efficiency in two ways. First, compressor capacity will increase approximately 6% for every 10° drop in condensing temperature. Second, system volumetric efficiency is increased since refrigerant BTU/lb. capacity is increased by 0.5% for each 1° drop in liquid refrigerant temperature.

Despite the lack of temperature and pressure controls at condenser 116, flash gas does not occur in the system of FIG. 2. Neither a bypass valve nor thermostatic fan control are needed at the condenser to suppress flash gas. Also, a subcooler unit is unnecessary. At the outlet from receiver 122, the liquid refrigerant in lines 126 and 129 is pressurized by pump 124 without added heat. Pump 124 raises the liquid refrigerant by approximately 5 to 12 PSI. Thus, the pressure $P_2$ in lines 126 and 129 is about 5 to 12 PSI greater than the pressure $P_1$ in line 120 and receiver 122. Such an increase in pressure is effective to overcome the formation of flash gas in the outlet lines leading to expansion valve 130.

The flow of pressurized liquid refrigerant via lines 126 and 129 through thermostatically-controlled expansion valve 130 is throttled to control refrigeration temperature at evaporator 134. The centerifugal pump continues to operate, even with flow blocked, to maintain the pressure $P_2$ without exceeding pressure limits of the system.

EXAMPLE

Benefits of using the present invention are analyzed in Table A for the example of a 100 ton refrigeration system operated to cool a freezer to 20° F. at different ambient or condensing temperatures from 20° F. to 100° F. Computations are rounded to five digits.

TABLE A

Power Use Comparison for Refrigerant 502
at Various Condensing Temperatures
Evaporator Temperature = 20° F.
System rating 100 tons (BTU/hr = 1,200,000)

| | | | | | |
|---|---|---|---|---|---|
| Condensing Temp. (°F.) | 100 | 80 | 60 | 40 | 20 |
| Enthalpy, Sat. Liquid, (BTU/lb) | 37.56 | 31.59 | 25.80 | 20.20 | 14.81 |
| Expansion Temp. (°F.) | 20 | 20 | 20 | 20 | 20 |
| Specific vol. @ intake cond. (cu ft/lb) | .61 | .61 | .61 | .61 | .61 |
| Enthalpy, Sat. Vapor, intake (BTU/lb) | 79.84 | 79.84 | 79.84 | 79.84 | 79.84 |
| Enthalpy, Condensed Vapor @ constant entropy (BTU/lb) | 89.5 | 87.0 | 85.0 | 82.0 | 79.84 |
| Work of Compression (BTU/lb) | 9.66 | 7.16 | 5.16 | 2.16 | .00 |
| Refrigerating effect (BTU/lb) | 42.28 | 48.25 | 54.04 | 59.64 | 65.03 |
| Flow of Refrigerant (lbs/hr) | 28382 | 24870 | 22206 | 20121 | 18453 |
| Operating Time (min/hr) | 60 | 53 | 47 | 43 | 39 |
| Power used (hp) | 107.73 | 69.97 | 45.02 | 17.08 | .00 |
| Power used (kwh) | 80.33 | 52.20 | 33.59 | 12.74 | .00 |
| Power demand (kw) | 80.33 | 59.54 | 42.91 | 17.96 | .00 |
| Volumetric Efficiency | | | | | |
| Clearance (% vol) | 10.00 | 10.00 | 10.00 | 10.00 | 10.00 |
| Specific Vol. at Discharge (cu ft/lb) | .18 | .24 | .32 | .45 | .61 |
| Residual refrigerant (lbs) | .56 | .42 | .31 | .22 | .16 |
| Expanded refrigerant (cu ft) (rounded off) | .33822 | .25367 | .19025 | .13529 | .1 |
| New charge (cu ft) | .66 | .75 | .81 | .86 | .90 |
| Change (%) (rounded off) | | .12777 | .22360 | .30665 | .35997 |
| Revised: Operating | | | | | |
| Time (min) | 60.00 | 46.62 | 38.36 | 32.55 | 26.68 |
| Power (kwh/hr) | 80.33 | 46.28 | 27.45 | 9.75 | .00 |
| Energy saved (kw) | .00 | 34.05 | 52.88 | 70.58 | 80.33 |

Table A described power consumption by the present invention at various condenser temperature levels. Refrigerant 502 is used, and a 20° F. evaporator temperature level is maintained. As shown, the system becomes more energy efficient as condenser temperatures are decreased relative to 100° F. (see last line of Table A).

For example, at an ambient temperature of 50° F., the compressor uses approximately 52.88 kw less power when the condenser temperature is reduced from 100° F. to 60° F. (By eliminating condenser temperature controls, the condenser temperature will drop to an equilibrium level of approximately 10° F. above the ambient temperature, or about 60° F. in the present example.) The decrease in power consumption directly results from reduced compressor head pressure due to lower condenser back pressure levels. In addition, lower condenser temperatures decrease system operating time per hour (see third from last line of Table A). This reduction translates into a corresponding decrease in the energy necessary to overcome frictional losses in the system, as shown in Table B.

TABLE B

Power Use Comparison for Refrigerant 502
at Various Condensing Temperatures
Evaporator Temperature = 20° F.
System rating 100 tons (BTU/hr = 1,200,000)
Friction (using empirical 108 kwh/100 Hp)

| | | | | | |
|---|---|---|---|---|---|
| Condensing Temp. (°F.) | 100 | 80 | 60 | 40 | 20 |
| Friction (kw/hr) | 33.40 | 25.95 | 21.36 | 18.12 | 15.97 |

TABLE B-continued

Power Use Comparison for Refrigerant 502
at Various Condensing Temperatures
Evaporator Temperature = 20° F.
System rating 100 tons (BTU/hr = 1,200,000)
Friction (using empirical 108 kwh/100 Hp)

| | | | | | |
|---|---|---|---|---|---|
| Total power (kw) | 113.73 | 72.24 | 48.81 | 27.87 | 15.97 |

Reducing condenser temperature from 100° F. to 60° F. reduces operating time from 60.00 minutes/hour to 38.36 minutes/hour, thereby decreasing frictional losses and saving another 12.04 kw/hr, as shown above.

In testing several smaller existing commerical refrigeration systems retrofitted in accordance with FIG. 2, and operated in accordance with the invention, actual savings have ranged from 26% to 38%.

A preferred embodiment of the present invention has been shown in the drawing and described above. However, it will be apparent to those skilled in the art that the invention can be modified in arrangement and detail without departing from its principles. In view thereof, I claim all modifications coming within the spirit and scope of the following claims.

1. A compression type refrigeration system, comprising:

an evaporator, a compressor, a condenser, a refrigerant receiver and conduit means interconnecting the same in a single closed loop for circulating refrigerant therethrough, the conduit means including a first conduit for circulating a flow of refrigerant from the receiver to the evaporator and a second conduit for circulating a return flow of refrigerant gas from the evaporator to the receiver solely through the compressor and the condenser for condensation by the condenser at a first pressure directly related to the head pressure at the compressor;

a variable flow expansion valve in the first conduit adjacent the evaporator for expanding the flow of refrigerant into the evaporator;

a centrifugal pump in the first conduit adjacent the receiver, the pump being adapted continuously during operation of the compressor to increase the pressure of the condensed refrigerant in the first conduit by a generally constant increment of pressure of at least five pounds per square inch to provide the refrigerant with a second pressure greater than the first pressure by the amount of said increment, the second pressure being sufficient to suppress flash gas and feed a completely condensed liquid refrigerant to the expansion valve, the first conduit circulating the refrigerant solely through the pump;

motor means for the pump; and a magnetic pump drive connecting the motor means to the pump to drive the same, whereby the pressure and the temperature of the refrigerant at the outlet of the condenser can be permitted to vary solely in response to ambient conditions at the condenser, and the pressure at the outlet of the condenser is substantially equal to the vapor pressure of the refrigerant.

2. The system of claim 1 in which the increment of pressure is between five and twelve pounds per square inch.

3. The system of claim 1 in which the condenser is operative independently of the pressure and the temperature of the refrigerant at the outlet of the condenser so that the first pressure and thereby the second pressure vary in response to variations in ambient conditions at the condenser.

* * * * *